US005409213A

United States Patent [19]

Yeh

[11] Patent Number: 5,409,213

[45] Date of Patent: Apr. 25, 1995

[54] SPORT PADDLE PROVIDING THE EFFECTS OF SOUND AND LIGHT

[76] Inventor: Peter S. Y. Yeh, 4F, 15, Lane 9, An Ho Rd., Taipei, Taiwan, Prov. of China

[21] Appl. No.: 748,048

[22] Filed: Aug. 21, 1991

Related U.S. Application Data

[63] Continuation-in-part of Ser. No. 612,970, Nov. 15, 1990, abandoned.

[51] Int. Cl.[6] ..... A63B 49/00; A63B 59/00

[52] U.S. Cl. ..... 273/67 R; 273/73 R; 273/29 A

[58] Field of Search ..... 273/29 A, 73 G, 67, 273/73 R

[56] References Cited

U.S. PATENT DOCUMENTS

| | | | |
|---|---|---|---|
| 3,649,787 | 3/1972 | Kasabian | 200/61.45 R |
| 4,101,132 | 7/1978 | Conrey et al. | 273/29 A |
| 4,222,563 | 9/1980 | Heftler | 273/29 A |
| 4,852,875 | 8/1989 | McLennan | 273/29 A |
| 4,911,441 | 3/1990 | Brunner | 273/29 A |
| 4,971,320 | 11/1990 | Nesbit et al. | 273/73 G |

FOREIGN PATENT DOCUMENTS

| | | | |
|---|---|---|---|
| 2942533 | 4/1981 | Germany | 273/29 A |

*Primary Examiner*—Mark Graham

*Attorney, Agent, or Firm*—Bacon & Thomas

[57] ABSTRACT

A sport paddle is disclosed having a circuit board substrate inside the handle which has a sound light circuit, a counter circuit, and a radio circuit. The opening and closing of the sound light circuit and the counter circuit are controlled by a vibration switch which is actuated. The sound light circuit is connected to an elastic concussion switch to give an amplified reverberatory sound and simultaneously cause a luminous body to illuminate whenever the ball is hit by the paddle. While the elastic concussion switch is connected, the counter circuit is also connected to display on a display screen the aggregated number of times of the ball has been hit. A radio circuit is also provided on the circuit board substrate inside a the handle of the paddle. The opening and closing of the radio circuit is controlled by a switch which allows the user to listen to the broadcasting of a radio station whether or not the paddle is being used in sport.

6 Claims, 5 Drawing Sheets

SPORT PADDLE PROVIDING THE EFFECTS OF SOUND AND LIGHT

RELATED APPLICATION

This application is a Continuation-in-Part of U.S. patent application Ser. No. 07/612,970 filed on Nov. 15, 1990, now abandoned.

BACKGROUND OF THE INVENTION

The present invention refers to an innovative design of a paddle providing the effects of sound and light. The effects of sound and light on hitting a ball by the user causes excitement and increases the interest in the device as both a sport racquet and a toy. The accompanying radio function makes the present invention different from the others and provides the dual benefits of practicality and innovation.

Conventional ideas about sports are restricted to physical exercise. Hardly anybody takes notice of how to cultivate interest in sports to enhancer the lasting benefit of exercise, especially in school age children. Without the interest, children's participation in sports will not last for a long time. The emphasis of sport facilities has always been the improvement of the quality of the facilities themselves as well as the operation generally. They neglected entirely inducements to attract the general public to engage in long lasting sports. Under such circumstances, sports have become professionalized, to be indulged in only by specific persons, the volition to engage in sports by general public being quite low.

In addition, as to school age children, interest in sports comes out of forming interesting images in the subconscious. Once the interesting conception is formed, it would attract them to engage in related activities continuously. For example, the reason that arcade amusement games attract school age children is due to the effects of sound and light of the machine which stimulates the senses of human body to cause excitement. This attraction results in a lot of school age children indulging in the playing of amusement games.

BRIEF SUMMARY OF THE INVENTION

In view of the above psychological factors, the inventor created a paddle providing the unique design by installing a circuit board substrate inside the handle of a paddle which comprises a sound light circuit, a counter circuit, and a radio circuit wherein: the opening and closing of the sound light circuit and the counter circuit are controlled by a switch; the sound light circuit is connected to an elastic concussion switch to give an amplified reverberatory sound and simultaneously cause a luminous body to illuminate whenever the ball is hit by the paddle. While the elastic concussion switch is connected, the counter circuit is also connected to display on a display screen the aggregated number of times of the ball has been hit. Accordingly, the main object of the present invention is to utilize the unique design of the paddle to provide the changes of sound and light, as well as to provide the counting of the number of times that the ball has been hit to make either the general public or school age children enjoy performing physical exercise.

Another object of the present invention is to provide a radio circuit on the circuit board substrate inside a boxlike handle of the present invention. The opening and closing of the radio circuit is controlled by a switch which allows the user to listen to the broadcasting of a radio station whether or not the paddle is being used in sport. This makes the paddle an interesting device with multiple functions to attract both the general public and school age children.

Other objects of the invention will be obvious from the above discussion and will appear from the following detailed description taken in conjunction with the accompanying drawings, wherein like reference numerals indicate like parts throughout.

DETAILED DESCRIPTION OF THE INVENTION

Figure 1:
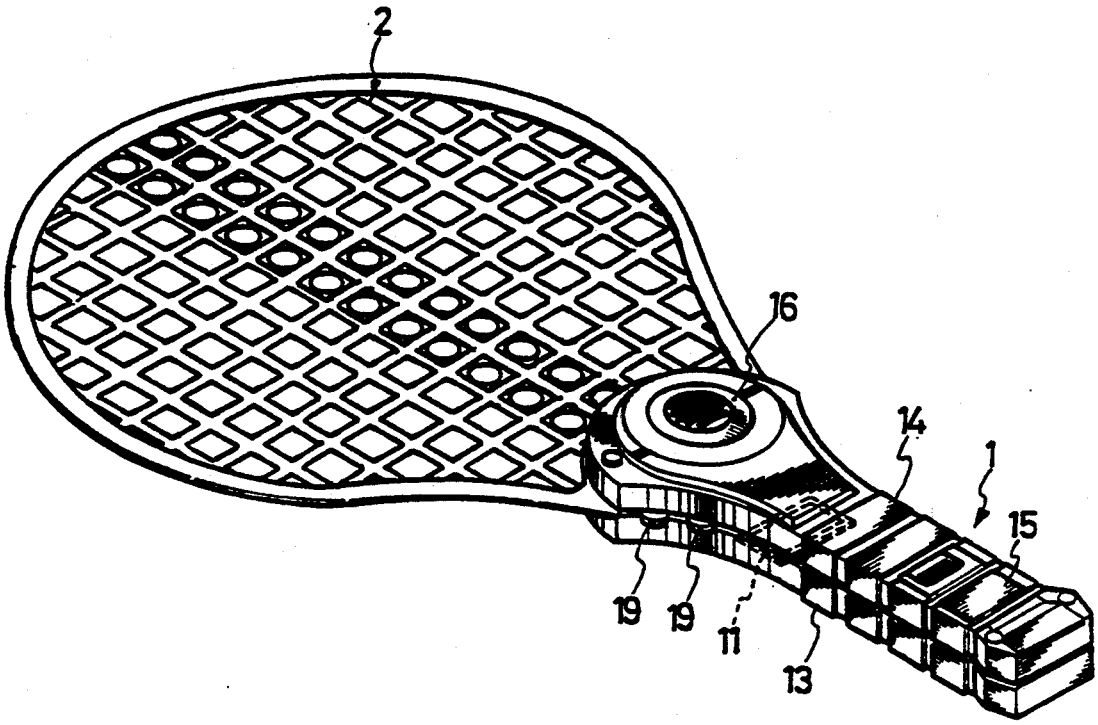
FIG. 1 is a perspective view of the present invention.

Refer to FIG. 1, the paddle providing the effects of sound and light of the present invention has a general shape similar to general paddles, wherein there is a hollow boxlike handle (1) containing related parts, components and fittings. The hitting surface of the paddle (2) is in the form of mesh or may be of other forms providing the appropriate effect of vibration transmission. A liquid crystal display screen (11), a luminous body (12), along with regulating switches and rotary buttons are provided on the surface of the handle (1) allowing the control of the changes of sound and light to be produced during the movement of the paddle on hitting the ball, as well as the function of counting the number of hits. The user is able to listen to the broadcasting of a radio station to increase the interest of the user and increase the persistence of exercise.

Figure 2:
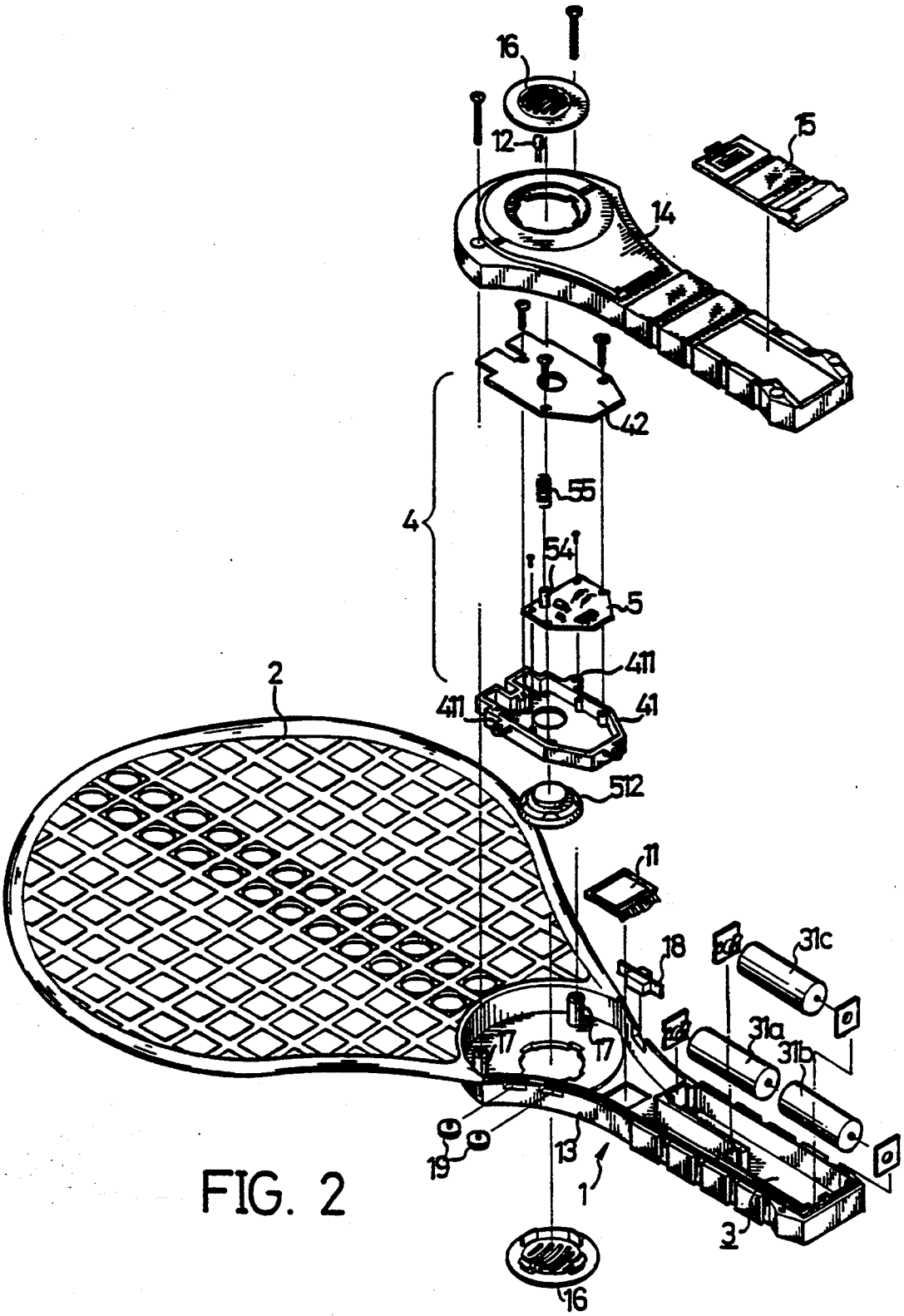
FIG. 2 is an exploded perspective view of the structure of the present invention.

Referring to FIG. 2, which is an exploded view of the present invention, it can be seen that the above boxlike handle (10) comprises a case (13), a case cover (14), and a battery bracket cover (15). The case cover (14) is fastened on the body of the case (13) by screws, and the battery cover (15), which is removable, is positioned on the top of the battery bracket (3) in the rear of the case of the handle (1) for the convenience of replacing the batteries **(31*a*) (31*b*). Transparent outer covers (16) with penetrating holes are provided on the top and bottom of the handle (1), the above covers (16) also being removable for the convenience of the assembly of the components inside the handle (1)**.

Figure 3:
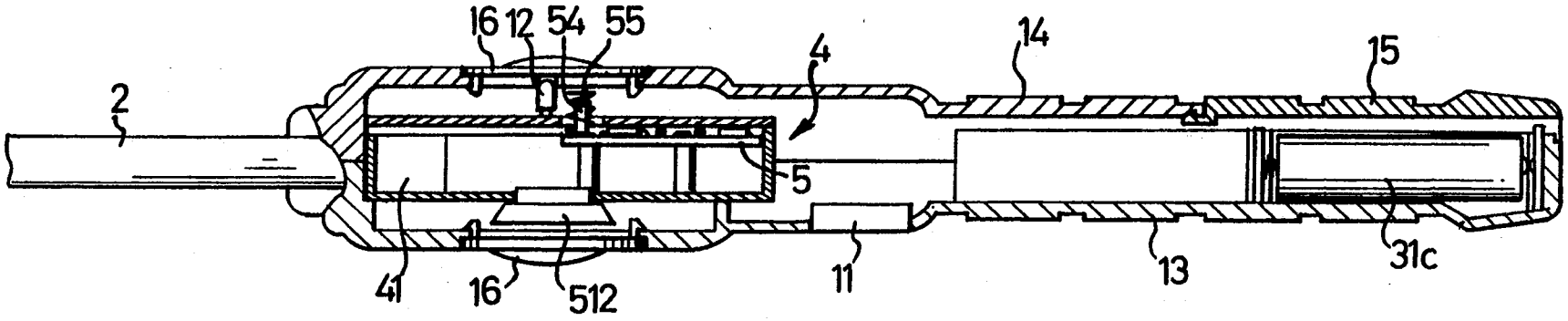
FIG. 3 is a partial cross-sectional view of the present invention.

Referring further to FIG. 2 and FIG. 3, there is a box or housing (4) in the handle (1) comprising a lower cover (41) and an upper cover (42) to be fastened thereon by screws, the lower cover (41) having lateral wings (411) with penetrating holes on two sides to match up with corresponding screw posts (17) inside the box of the handle (1) so as to fix the case cover (14) inside the handle (1). A circuit board substrate (5) is fixed in the case (4) and has a sound light circuit (51), a counter circuit (52) and a radio circuit (53), the action and arrangement of the above circuits will be described in more detail hereinafter. The circuit board substrate (5) also provides a conducting rod (54) encased with a conducting spring (55) to form a vibrating switch (56). The conducting rod (54) is fixed on a related position of the circuit board substrate (5), as is one end of spring (55), allowing the contact of the conducting rod (54) with the inner portion of the conducting spring (55) resulting in the connections of the above circuits to facilitate the action of the above circuit system. The conducting rod (54) is installed inside the conducting spring (55) which has excellent vibrating elasticity such that the spring member is located concentrically about the conducting rod. When the circuit board substrate (5) is installed inside the handle (1), the vibrating energy produced by the hitting the ball on the surface of the paddle (2) causes the bending of the conducting spring (55) so as to contact the conducting rod (54) to attain the effect the conductance. One of the rod and spring members is electrically connected to the source of electrical power and the other of the rod and spring member is electrically connected to the sound light circuit and the counter circuit.

Figure 4:
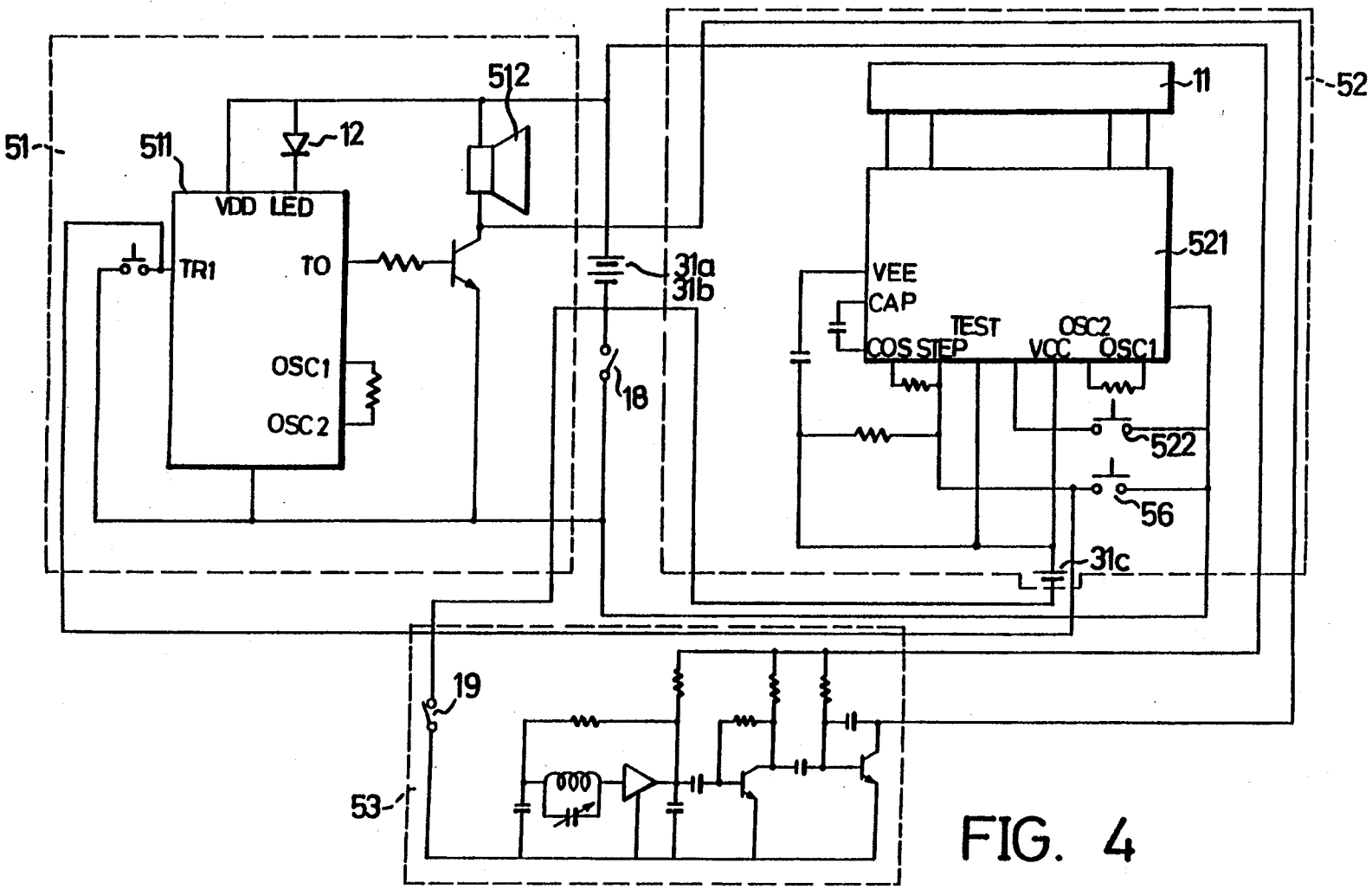
FIG. 4 is a schematic circuit diagram of the circuit of the present invention.
Figure 6:
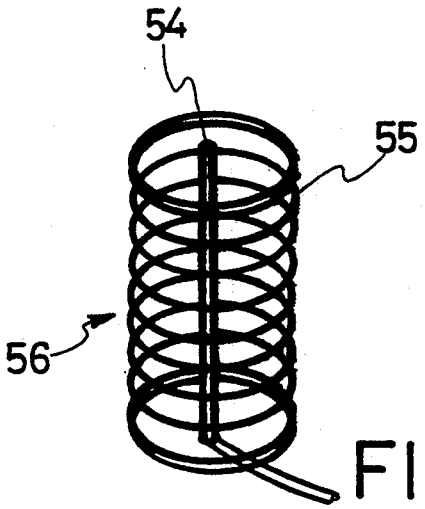
FIG. 6 is an enlarged, perspective view of the vibrating switch shown in FIG. 5.
Figure 5:
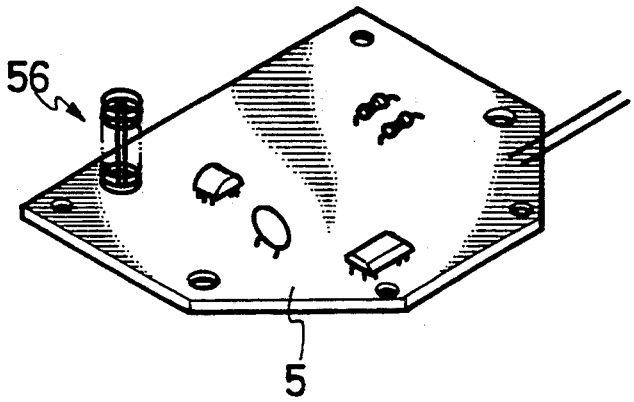
FIG. 5 is a perspective view of the circuit board substrate illustrating the attachment of the vibrating switch.

With respect to the circuits of the present invention, as illustrated in FIG. 3 and FIG. 4, they comprise a sound light circuit (51), a counter circuit (52) and a radio circuit (53). The electric energy for the sound light circuit (51), and the counter circuit (52) is supplied by the batteries (31*a*) (31*b*) in the battery bracket (3) inside the box of the handle (1) (as shown in FIG. 1). The opening and closing of these circuits are controlled by the switch (18) on the handle (1). The electric energy for the radio circuit (53) is supplied by another battery (31*c*), the opening and closing of which and the change of stations of the radio circuit (53) being controlled and operated by two regulating rotary buttons (19) installed on the side of the handle (1). The above circuits are also controlled by the vibrating switch (56) constituted by the conducting rod (54) and the conducting spring (55) which extend through an opening in the housing to have them be initiated simultaneously on the hitting of the ball by the paddle. Them is a luminous body (12) and a speaker (512), controlled by an integrated circuit (511) in the sound-light circuit (51), wherein the luminous body (12) is installed inside the transparent upper cover (16), and the speaker (512) is installed inside the transparent lower cover (16). They produce instant light as well as the reverberatory sound of the hitting of the ball simultaneously once the circuits are turned on. The counter circuit (52) also comprises a surface liquid crystal display screen (11) and a counter (521) installed on the case (13) allowing the display of the aggregated number of times of the ball was hit by the paddle on the display screen (11). A return to zero switch (522) is provided which may be pressed to return the figure displayed on the screen to zero. This makes the paddle more lively and interesting.

In addition, the circuits of the present invention comprise also a radio circuit (53), the opening and closing of the circuit and the transfer of stations being controlled by independent regulating rotary buttons (19). It is able to be used as a radio while the paddle is not used in sport or it may be switched on when the paddle is being used in sport combine sport with amusement.

To sum up, the paddle combines multiple functions to provide the effects of amusement, sport, and interest to maintain the volition of the user to engage in sport.

Repeated experiments prove that the structure of the present invention is simple and convenient is use. As can be appreciated, the present invention represents a marked improvement over the known art in providing a simple structure for a paddle that can be used as a tool of sport.

I claim:

1. A game paddle used to strike a game object wherein the game paddle has a generally flat object striking area and a handle adapted to be gripped by the user, the paddle comprising:

a) a source of electrical power;

b) first electrical circuit means;

c) second electrical circuit means;

d) a light source operatively connected to the first electrical circuit means such that, when the first electrical circuit means is electrically connected to the source of electrical power, the light source is illuminated e) speaker means operatively connected to the first electrical circuit means such that, when the first electrical circuit means is electrically connected to the source of electrical power, the speaker means emits a sound;

f) counter means operatively connected to the second electrical circuit means such that the counter means is advanced each time the second electrical circuit is connected to the source of electrical power; and, g) vibration actuated switch means electrically connected between the source of electrical power, and the first and second electrical circuits, such that the switch means is normally open and is closed by vibration in the paddle caused by the paddle striking the game object, wherein the vibration actuated switch means comprises:

i) an electrically conducting rod;

ii) an electrically conducting spring member located such that it is normally out of electrical contact with the rod, but is brought into electrical contact with the rod by vibration in the paddle; and, iii) means electrically connecting one of the rod and spring members to the source of electrical power and the other of the rod and spring member to the first and second electrical circuit means.

h) a housing enclosing the first and second electrical circuit means wherein the housing defines an opening through which a portion of the conducting rod and spring member extend; and, i) means to mount the housing within the handle of the paddle.

2. The paddle of claim 1 wherein the spring member is located concentrically about the conducting rod.

3. The paddle of claim 1 further comprising visual display means operatively connected to the counter means to visually display the number of times the second electrical circuit is connected to the source of electrical power.

4. The paddle of claim 3 wherein the visual display means comprises a liquid crystal display.

5. The paddle of claim 1 further comprising a radio circuit to receive radio signal broadcasts.

6. The paddle of claim 1 wherein the source of electrical power comprises at least one battery located in the handle of the paddle.

* * * * *